US005791975A

United States Patent [19]

Cesna et al.

[11] Patent Number: 5,791,975

[45] Date of Patent: Aug. 11, 1998

[54] BACKING PAD

[75] Inventors: Joseph V. Cesna, Niles, Ill.; Chris E. Karlsrud; Spencer Preston, both of Chandler, Ariz.

[73] Assignee: Speedfam Corporation, Des Plaines, Ill.

[21] Appl. No.: 513,080

[22] Filed: Aug. 9, 1995

Related U.S. Application Data

[63] Continuation-in-part of Ser. No. 115,164, Sep. 1, 1993, abandoned.

[51] Int. Cl.[6] ..... B24B 1/00; B24B 7/16; B24B 7/30; B24B 29/00

[52] U.S. Cl. ..... 451/63; 451/285; 451/287; 451/288; 451/364

[58] Field of Search ..... 428/141; 51/299, 51/63; 451/364, 388, 390, 548, 550, 901, 921, 285, 287, 288, 289, 290, 41, 259, 279, 272, 277

[56] References Cited

U.S. PATENT DOCUMENTS

| | | | |
|---|---|---|---|
| 3,842,544 | 10/1974 | Paola | 51/129 |
| 4,132,037 | 1/1979 | Bonora | 51/131 |
| 4,141,180 | 2/1979 | Gill, Jr. et al. | 51/5 |
| 4,145,266 | 3/1979 | Hayasaka et al. | 204/131 |
| 4,519,168 | 5/1985 | Cesna | 51/216 LP |
| 4,664,890 | 5/1987 | Brandt | 51/283 R |
| 4,715,115 | 12/1987 | King et al. | 29/841 |
| 4,733,502 | 3/1988 | Braun | 51/284 R |
| 4,918,872 | 4/1990 | Sato et al. | 51/209 R |
| 5,101,602 | 4/1992 | Hashimoto | 51/216 LP |
| 5,156,900 | 10/1992 | Nishimura | 428/151 |
| 5,267,418 | 12/1993 | Currie et al. | 51/216 |
| 5,335,457 | 8/1994 | Matsuda et al. | 51/284 |
| 5,384,988 | 1/1995 | Hernanadez | 451/42 |

*Primary Examiner*—Vivian Chen

*Attorney, Agent, or Firm*—Fitch, Even, Tabin & Flannery

[57] ABSTRACT

A method of fabricating a soft, resilient backing pad adapted for attachment to a pressure plate for planarizing work pieces wherein the outer exposed surface of the pad has been abraded by means of dry abrasive particles fixed on a surface of a spherical convex lapping wheel.

2 Claims, 2 Drawing Sheets

BACKING PAD

This application is a continuation-in-part of application Ser. No. 08/115,164, filed Sep. 1, 1993, abandoned.

BACKGROUND OF THE INVENTION

1. Field of the Invention

This invention relates to the art of planarization of work pieces such as thin wafers or discs of silicon that are used for the fabrication of solid state circuit components.

2. Description of the Related Art

In the fabrication of multilevel integrated circuits a number of electrically conductive layers separated by a dielectric material are disposed on thin wafers, generally thin silicon wafers. For satisfactory performance, projecting features on the face of the built up wafers must preferentially be removed in order to produce a flat planar surface. This removal of projecting features is referred to as planarization. Chemical-Mechanical Polishing (CMP) is widely used to planarize such wafers. CMP planarization consists of the controlled wear of the wafer surface by a rotating elastomeric polishing pad in combination with a liquid suspension of abrasive particles (slurry). A wafer is disposed between a carrier or pressure plate and a rotatable polishing table carrying on its surface a polishing pad. The pressure plate applies pressure so as to effect removal of projections from the face of the built-up wafer and to produce a surface of substantially uniform thickness and planarity. As the polishing pad travels across the wafer surface, abrasive particles are forced against the face surface of the wafer at the points of contact. Thus, wear occurs due to sliding friction between wafer surface and abrasive particles. CMP follows the front contour of the wafer (front referencing) rather than the back and has been used successfully for planarizing both dielectric and conductive (metal) layers deposited on thin wafers.

Equipment useful in planarization processes is well known in the art. Generally, such apparatus includes a rigid pressure plate or carrier to which is secured a backing pad. The back side of the wafer engages the backing pad with the wafer front surface exposed to a polishing pad which engages the same with polishing pressure. The polishing pad and carrier are then typically both rotated at differential velocities to cause relative lateral motion between the polishing pad and the wafer front side surface. An abrasive slurry, such as a colloidal silica slurry, is generally provided at the polishing pad-wafer surface interface during the polishing operation to aid in the polishing.

The typical planarization machine includes a rotating polishing wheel which is rotatably driven about a vertical axis. Typically, the polishing wheel comprises a horizontal ceramic or metallic platen which can be formed of various materials, as is known in the art, and which are available commercially. Typically, the polishing pad is a blown polyurethane, such as the IC and GS series of polishing pads available from Rodel Products Corporation of Scottsdale, Arizona. The hardness and density of the polishing pad is routinely selected based on the type of material that is to be planarized. The polishing pad is rotated about a vertical axis and has an annular polishing surface on which the work pieces are placed in confined positions onto which an abrasive slurry, such as an aqueous slurry of silica particles, is pumped. The joint functions of the pad, the slurry, and the relative movements of the components produces a combined mechanical and chemical process at the wafer front surface which removes projections and produces a substantially flat or planar surface on the wafer.

The degree of planarization necessary depends, of course, on the topography of the layer to be planarized. However, the number of additional layers which are going to be superimposed on the device must be considered since the result of nonplanar first layers are exaggerated in each subsequent layer, and planarization of higher layers become increasingly difficult. Planarization requirements have become more stringent in recent years, particularly with respect to surface uniformity or planarity. Recent art planarization specifications require that the wafers exhibit a surface planarity or uniformity above about 90%, that is, not more than 10% and preferably about 5% of the planarized surface of a wafer should not deviate from a desired plane.

SUMMARY OF THE INVENTION

Accordingly, it is a major object of this invention to provide improvements in planarization of work pieces.

The present invention involves the discovery that planarization of work pieces can be significantly improved by use of backing pads having certain characteristics.

In accordance with this invention there is provided improved backing pads for use in machining, particularly planarization of thin work pieces carrying deposited dielectric and conductive layers. The invention involves a backing pad adapted for attachment to a flat, rigid pressure plate used in machines for machining thin work pieces. The outer exposed surface of the backing pad is abraded, in dry state, to achieve a high degree of flatness on the pad surface and to raise thereon a cushioning surface nap. These important desiderata are accomplished by securing a backing pad to a flat, rigid pressure plate, such as a metal or ceramic plate, and then subjecting the exposed surface of the pad to a dry abrading action to create a nap on the surface and achieve surface flatness. Preferably, the abrading action is conducted at ambient temperature by using a layer of dry abrasive material deposited on a lapping wheel having a profile or shape mirroring the profile desired for the finished backing pad. In this way, the surface of the finished backing pad has a surface profile which corresponds to that of the lapping wheel. Thus, if it is desired that the backing pad have a convex spherical profile, the lapping wheel used for abrasion would have a corresponding concave spherical profile.

The improved backing pads of the invention are composed of a relatively soft material having sufficient rigidity and strength to be securable to a flat, rigid pressure plate and to firmly retain a thin work piece in position when the pressure plate moves a work piece into pressure contact with a polishing pad for planarization of the work piece. The material used for the backing pads of this invention will have a Durometer Shore A Hardness (ASTM) of not more than about 60 (+5%). Preferably the soft material used in the backing pad has sufficient resiliency so that when subjected to a compressive force assumes its original surface profile when the compressive force is released. Generally, the backing pad is sufficiently resilient for use when a substantially uniform textured surface having a raised nap has been created and when subjected to a compressive pressure of 5–10 psi does not compress to more than about ⅕ of its thickness with the pad having the ability to spring back to its original state after pressure is released. The resiliency of the pad can be determined by compression and memory tests. Uniform physical characteristics throughout the material are desired, including compressibility and coefficient of friction. The softness or resilient characteristic of the material used to form the backing pad enables the pad to be fabricated so as to have a desired flatness and a cushioning effect so as to prevent surface irregularities on the back side of the work piece or wafer from being transferred to the front surface thereof undergoing planarization. Representative materials preferred for use to produce backing pads in accordance with this invention are Rodel WB20, DF 200 and 40 Film available from Rodel Corporation, Scottsdale, Ariz.; PB 100 AD2 available from Robus Leather Corp., Madison, Ind.; and UT-505 pads available from UTEC Corporation, Chandler, Ariz.

The size of the backing pad can vary depending upon the size of the work piece to be machined such as, for example, 5, 6 or 8 inches in diameter, to accommodate similarly sized silicon wafers and other similar thin work pieces.

To prepare the improved backing pads of this invention, the pad material is mounted on the surface of a pressure plate of a lapping machine. Lapping machines and pressure plates used therein are well known and the improved backing pads of this invention can be formed utilizing conventional lapping machines such as disclosed, for example, in U.S. Pat. No. 4,270,314 and U.S. Pat. No. 4,141,180.

In fabrication, the backing pad material is secured to the outer exposed surface of a pressure plate by any suitable means, such as by the use of adhesives or double sided adhesive tapes. Excess adhesive and air are expressed from between the pad and pressure plate by expedients such as moving a roller or the like over the surface of the pad. Suitable adhesives for securing the pad to the pressure plate are, for example, double sided adhesive tapes, spray contact cements, carpet tape and the like.

After mounting of the pad material to the pressure plate, the exposed outer surface is then subjected to the abrading action of a dry abrasive material affixed preferably to a conventional lapping wheel so as to conform thereto and present the same surface contour of the lapping wheel. As is known, lapping wheels can be essentially flat and can have either a convex or concave configuration or profile. The lapping wheel employed for abrading will preferably have a profile mirroring that desired for the finished backing pad. Suitable abrasive materials include, for example, silicon carbide sandpaper, mylar impregnated abrasive film and the like, or a diamond plated lapwheel can be used in this operation. The abrasive particles are desirably substantially the same size and, if necessary, a truing ring can be used to achieve substantial uniformity of the abrasive material.

The abrading action is conducted under suitable pressure for a time sufficient to create a nap on the pad surface and to impart a desired flatness to the pad. The nap created on the backing pad surface is substantially uniform over the surface and is the result of the cutting or abrading action which disturbs the smoothness of the surface and creates a fuzzy textured surface having upraised ends of the backing pad material protruding therefrom.

Preferably, backing pads used for planarizing silicon wafers are abraded so as to produce a surface having a high degree of flatness or planarity. Preferably, the flatness is such that no part of the pad surface varies from a true plane no greater than plus or minus 0.000040 inch and more preferably the surface variation is no greater than plus or minus 0.000010 inch. In any event, abrading of the pad is conducted so as to produce a desirably flat or planar surface on the pad so that the thickness of the pad throughout does not vary more than about 10%. Abrading the exposed surface of the backing pad material on a lapping wheel of desired profile contours the pad without requiring the use of heat. Abrading the backing pad generates a uniform surface roughened texture or nap on the pad which prevents a work piece from sliding under polishing side forces. Also, abrading provides surface roughness or nap on the pad so that water disperses in a uniform layer under a wafer during a planarization operation. The abrading action also exposes and corrects surface defects and deburrs vacuum hole passages thereby enhancing the seal between the pad and work piece at the location of the vacuum holes thus promoting improved handling of the work piece. Moreover, abrading the pad enhances the vacuum holding characteristics of the pad by increasing the surface area (nap) exposed to vacuum.

After abrading, the surface of the abraded backing pad is cleaned by use of a water or air spray or other known cleaning means. The backing pad attached to a pressure plate is then ready for use in a SpeedFam Corporation CMP-V planarization machine or other machine to planarize thin work pieces such as silicon wafers.

BRIEF DESCRIPTION OF THE DRAWINGS

The present invention and the advantages thereof will be further apparent from the following description taken in conjunction with the drawings wherein.

DETAILED DESCRIPTION OF THE PREFERRED EMBODIMENTS

Figure 1:
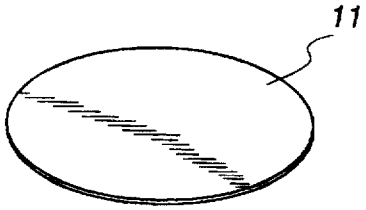
FIG. 1 is a perspective view of a typical backing pad used in machining thin work pieces, such as silicon wafers.
Figure 2:
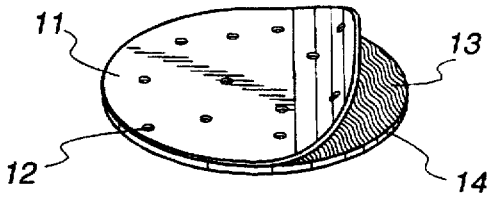
FIG. 2 is a perspective view showing application of a typical backing pad to a pressure plate used in conventional lapping machines.

Referring to the drawings (FIG. 1) numeral 11 refers to a 8-inch diameter backing pad having a thickness of 0.020 inch composed of white urethane product, WB-20 with PSA II adhesive and available commercially from Rodel Corporation. Vacuum access apertures 12 (FIG. 2) are provided in the pad after mounting on a pressure plate to permit a vacuum to be applied through the pad so as to hold a work piece during wafer handling. The use of vacuum means for retaining work pieces such as silicon wafers during handling is commonly employed.

The pad 11 is secured to a rigid, flat metal or ceramic pressure plate 14 (FIG. 2) by use of an adhesive 13 such as PSA II or double side adhesive tape. The pressure plate 14 has a diameter corresponding to the backing pad and is utilized for machining work pieces of various sizes, illustratively an 8-inch diameter silicon wafer. Vacuum access apertures are provided in pressure plate 14 to permit use of vacuum holding means.

Figure 3:
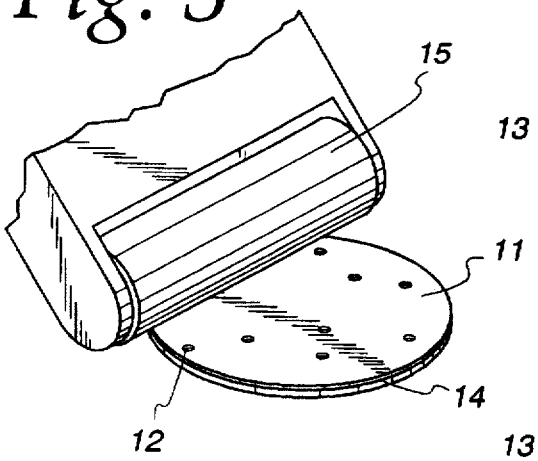
FIG. 3 is a perspective view showing one means of flattening the backing pad against a pressure plate.

After placing the pad 11 on the pressure plate, excess adhesive and air are expressed from the laminated structure such as by rolling the surface of the pad with a roller 15 (FIG. 3) or similar flattening element.

Figure 4:
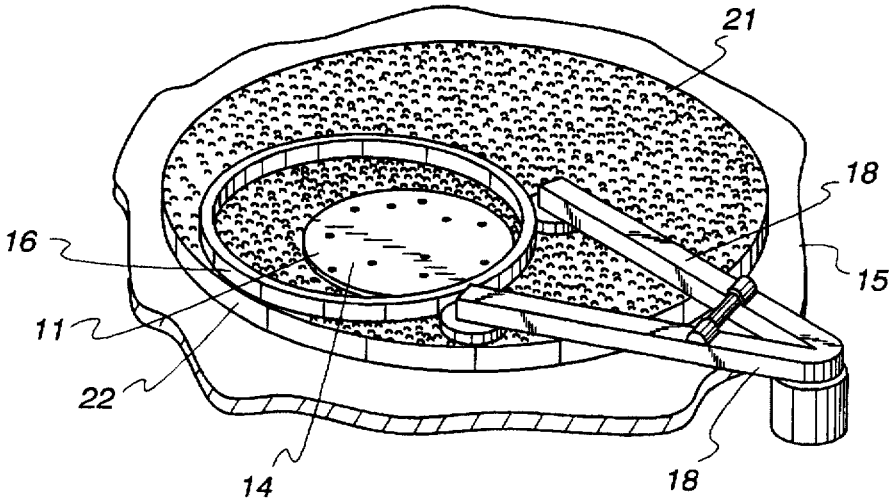
FIG. 4 is a fragmentary view of a conventional lapping wheel which carries on its upper surface a layer of an abrasive material and showing a backing pad attached to a pressure plate in position for abrading by rotation of the lapping wheel.

The next step in preparing the advantageous backing pad of this invention is to abrade or grind the exposed outer surface of the pad. Thus, as shown in FIG. 4, the pressure plate 14 and pad 11 are placed within a suitable retaining ring 16 which is guided by a pair of rigid and adjustable holding arms 18. The pressure plate and pad are placed on a lapping wheel in an inverted position as compared to FIG. 3, that is, the pad is at the bottom so as to contact the abrasive material layer 21 which is affixed to the surface of lapping wheel 22. Abrading of the exposed surface is conducted by rotating the lapping wheel under dry conditions for a sufficient time to obtain the flatness required for the backing pad and to free it of substantially all surface irregularities. Typically, the lapping wheel carrying the abrasive material 21 is operated for a period of say 5 to 10 minutes depending upon the flatness of the original pad and the flatness desired in the finished pad. Representative of the abrasive materials 21 which are affixed to the lapping wheel 22 are 220 mesh silicon carbide sanding paper and 50 micron mylar backed film available from Minnesota Mining and Manufacturing Co. (3M).

Figure 8:
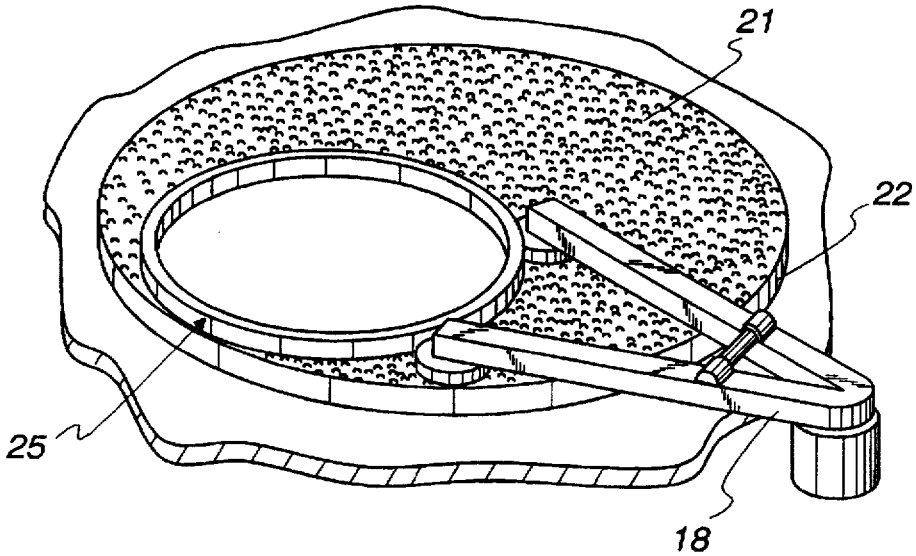
FIG. 8 is a fragmentary view of a conventional lapping wheel carrying on the upper surface a layer of an abrasive material and showing one means for reducing the coarseness of the abrasive layer.

If desired, before abrading the backing pad the abrasive surface layer 21 can be somewhat polished or sized to reduce its coarseness by lapping it with a cylindrical cast iron truing ring 25 (FIG. 8). By oscillating arm 18, the truing ring traverses the entire surface of the abrasive layer 21 on the lapping wheel. Dressing the abrasive surface 21 is preferable when the abrasive is of very coarse nature.

Figure 7:
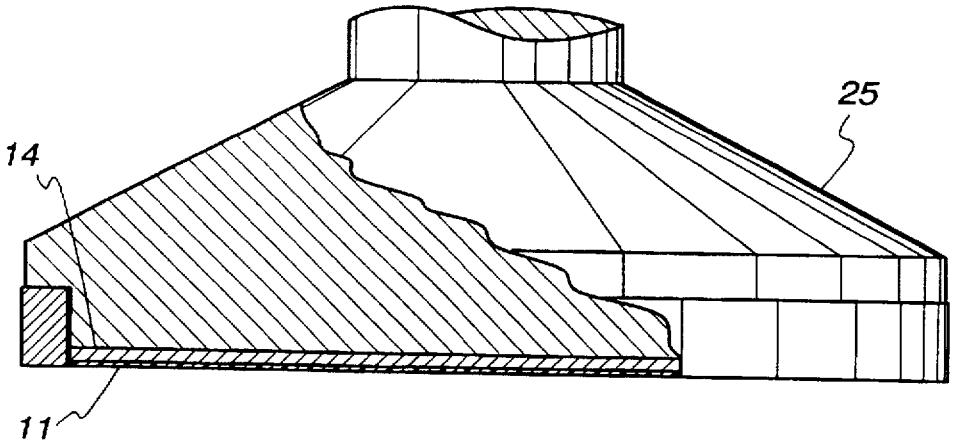
FIG. 7 is a side schematic view showing the positioning of a pressure plate and backing pad within a typical chuck used in lapping and polishing machines.

After abrading the pad, it can be cleaned by use of vacuum or air spray and its flatness profile checked by means of a spherometer as is known in the art. The pad firmly affixed to the pressure plate is then ready for insertion into a polishing or planarization machine chuck 25 (FIG. 7) and it is then ready for use in a polishing operation.

Figure 5:
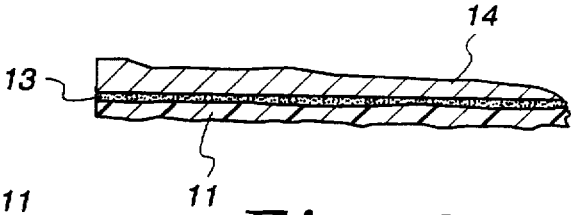
FIG. 5 is a fragmentary side view of a typical commercial backing pad attached to a pressure plate which is not fabricated in accordance with the invention.
Figure 6:
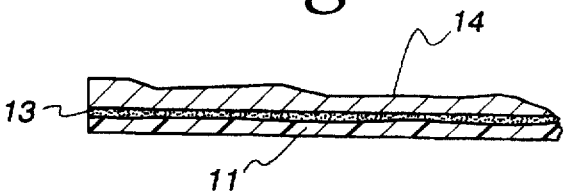
FIG. 6 is a view similar to FIG. 5 showing the improved exposed surface of a backing pad when fabricated in accordance with the invention.

Commercially available backing pads, while ostensibly flat, do not possess the extreme flatness characteristics required for critical polishing of work pieces such as thin silicon wafers. The typical commercial backing pad as illustrated in FIG. 5 has a total out of flatness of 0.0003 inch to 0.0005 inch, whereas the backing pad fabricated in accordance with this invention, as illustrated in FIG. 6, has a total out of flatness of say 0.000020 inch (i.e. ½ micron).

Backing pads according to this invention can be of various sizes, depending upon intended usage and particularly the size of work pieces to be planarized.

Those modifications and equivalents which fall within the spirit of the invention are to be considered a part thereof.

What is claimed is:

1. A process for fabricating a backing pad adapted for attachment to a rigid metal or ceramic pressure plate for planarizing wafers for solid state circuit components which comprises securing to a pressure plate a compressible backing pad material, then cutting the exposed surface of the backing pad material with dry abrasive particles fixed on a surface of a rotating sphericl convex lapping wheel.

2. A process in accordance with claim 1 wherein sandpaper carrying said dry abrasive particles is fixed on the rotating lapping wheel.

* * * * *